US009832572B2

(12) United States Patent
Gerlach

(10) Patent No.: US 9,832,572 B2
(45) Date of Patent: Nov. 28, 2017

(54) ELECTROACTIVE SOUND TRANSDUCER FOIL HAVING A STRUCTURED SURFACE

(71) Applicant: Robert Bosch GmbH, Stuttgart (DE)

(72) Inventor: Andre Gerlach, Leonberg-Hoefingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 19 days.

(21) Appl. No.: 14/553,489

(22) Filed: Nov. 25, 2014

(65) Prior Publication Data

US 2015/0146895 A1 May 28, 2015

(30) Foreign Application Priority Data

Nov. 25, 2013 (DE) ..... 10 2013 223 979

(51) Int. Cl.
*H04R 17/00* (2006.01)

(52) U.S. Cl.
CPC ..... *H04R 17/00* (2013.01); *H04R 17/005* (2013.01)

(58) Field of Classification Search
CPC .. H04R 17/00; H04R 17/005; H04R 2499/11; H04R 2499/15; H04R 7/045; H04R 7/06; H04R 2307/00; H04R 2201/003
USPC ..... 381/190
See application file for complete search history.

(56) References Cited

U.S. PATENT DOCUMENTS 4,005,278 A * 1/1977 Gorike ..... H04R 5/033 181/137
4,056,742 A * 11/1977 Tibbetts ..... B06B 1/0688 310/334
4,158,753 A * 6/1979 Gorike ..... H04R 1/2811 381/19
4,160,135 A * 7/1979 Gorike ..... H04R 1/2834 381/372
4,278,852 A * 7/1981 Gorike ..... H04R 1/24 381/354
4,638,207 A 1/1987 Radice
5,767,612 A * 6/1998 Takeuchi ..... B41J 2/161 310/324
5,889,353 A * 3/1999 Takeuchi ..... B41J 2/161 310/330
5,940,947 A * 8/1999 Takeuchi ..... B41J 2/161 29/25.35
6,028,389 A * 2/2000 Bernstein ..... H04R 17/00 310/311
6,831,985 B2 * 12/2004 Takei ..... H04R 17/00 381/190
7,038,356 B2 * 5/2006 Athanas ..... H04R 17/00 310/311

(Continued)

FOREIGN PATENT DOCUMENTS

DE 102010043108 5/2012

*Primary Examiner* — Davetta W Goins
*Assistant Examiner* — Jasmine Pritchard
(74) *Attorney, Agent, or Firm* — Norton Rose Fulbright US LLP; Gerard Messina

(57) ABSTRACT

An electroactive sound transducer foil includes a composite foil made up of at least one carrier foil, at least one first and one second electrode, and at least one piezoelectric layer including an electroactive polymer, the surface of the sound transducer foil including a structuring having different slopes, and the slope of the sound transducer foil surface changing the sign at least twice.

16 Claims, 3 Drawing Sheets

(56) References Cited

U.S. PATENT DOCUMENTS

| | | | | |
|---|---|---|---|---|
| 8,379,888 | B2 * | 2/2013 | Lee | H04R 17/005<br>381/116 |
| 2006/0011737 | A1 * | 1/2006 | Amenos | A01M 1/2033<br>239/102.1 |
| 2009/0285431 | A1 * | 11/2009 | Carlson | H04R 1/028<br>381/345 |

* cited by examiner

ELECTROACTIVE SOUND TRANSDUCER FOIL HAVING A STRUCTURED SURFACE

FIELD OF THE INVENTION

The present invention relates to an electroactive sound transducer foil including a composite foil made up of at least one carrier foil, at least one first and one second electrode, and at least one piezoelectric layer including an electroactive polymer, the surface of the sound transducer foil including a structuring having different slopes and the slope of the sound transducer foil surface changing the sign at least twice.

BACKGROUND INFORMATION

Established electrodynamic sound transducer concepts usually use diaphragms which are centrally connected to an electromagnetic voice coil and are caused to vibrate either by Lorentz forces induced by current flow or by air movements. Depending on the operating mode, either an electric current is converted into mechanical movement or a diaphragm movement is converted into an electric current. With these design forms, for example, moving coil loudspeakers or microphones are obtainable, which today are characterized by high sound intensity and natural sound reproduction.

However, the suspension of the diaphragm and the special electrodynamic coupling with the aid of a magnet result in certain overall depths and vibration characteristics which are not suitable for every design and application situation. For this reason, sound transducers which are not based on a diaphragm-coil-magnet combination, but which use piezoelectric effects for sound conversion, were developed in the last few decades. These sound transducers include electroactive ceramics or plastic materials and allow direct sound conversion due to the changes of the macroscopic sound transducer dimensions as a function of an electric field. For example, the application of a voltage to a piezoelectric diaphragm or foil results in a change of the longitudinal extension (d31) and thickness extension (d33). The d31 effect in particular results in bending of the layer, which may be effectively used for sound radiation. Conversely, a mechanical load results in an electric charge transfer within the layer, which may generally be used for sound detection. These piezoelectric sound transducers require only very minor deflections. In the case of loudspeakers, the deflections are typically in the range of several hundred μm, while the deflections in the range of microphone applications are only several hundred μm to just a few nm or pm. In the case of loudspeakers as well as in the case of microphones, the deflections are very strongly dependent on the frequency. At higher frequencies, smaller deflections occur than at lower frequencies. As a result of these basic conditions, in particular foil transducers having only a very small distance from other surfaces may be implemented, which previously were not accessible with the established electromagnetic diaphragm-coil systems.

One possible specific embodiment for unusual transducer geometries is known, for example, from U.S. Pat. No. 4,638,207 A, which describes the use of a piezoelectric polymer which is based on polyvinylidene fluoride (PVDF) for manufacturing balloon-shaped loudspeakers. PVDF strips, which are embedded between an outer and an inner coating, are applied to a balloon, or the balloon itself is formed from such strips.

In one further embodiment, DE 10 2010 043 108 A1 describes a piezoelectric sound transducer using a piezoelectric plastic material. In particular, a sound transducer is described which is essentially composed of a carrier layer and a layer of a piezoelectric plastic carrier applied thereto, the piezoelectric plastic layer not entirely covering the carrier layer, but having recesses.

The design of preferably effective and reliable piezoelectric transducers, however, previously required a compromise in the attachment of the transducer foils. Full-surface, direct fixation of the transducer foils to surfaces, for example by adhesive bonding, creates a secure attachment of the transducer, but results in a very strong impairment of the deflectability, which disadvantageously affects the transducer effectiveness. For this reason, the electroactive foils are situated as a composite on a flexible carrier foil, and the composite is held mechanically at its edges, to obtain a preferably unimpaired vibration behavior. This enables designs in which the composite is sufficiently mechanically fixed and therefore stabilized and may otherwise vibrate freely. This results in a favorable radiation or reception characteristic; however, it reduces the overall mechanical load capacity of the transducer at the non-attached locations and is thus disadvantageous.

It is therefore the object of the present invention to provide an electroactive sound transducer foil which exhibits good vibration behavior and which, due to its design and geometry, may be easily and securely attached to a wide variety of surface geometries, without the vibration characteristics of the foil being too strongly impaired.

SUMMARY

It has been found that an electroactive sound transducer foil including a composite foil made up of at least one carrier foil, at least one first and one second electrode, and at least one piezoelectric layer including an electroactive polymer, characterized in that the surface of the sound transducer foil includes a structuring having different slopes and the slope of the sound transducer foil surface changes the sign at least twice, exhibits an improved radiation behavior and higher efficiency than standard flat or only singly curved, electroactive sound transducer surfaces. Without being bound by theory, the improved transducer properties may result from the structuring of the foil surface, which also leads to a higher overall surface of the foil per unit of area. This is the case compared to standard foil surfaces which are either designed to be only flat or only singly curved. Moreover, the structuring of the surface may result in an improved dynamic behavior of the foil since the mechanical dimensional changes of the foil, as a function of an applied electric field, for example, may be spatially better derived due to the different surface slopes, without any undesirable interactions of different subareas of the transducer occurring. This may in particular be based on the fact that the transducer surface includes multiple areas having different slopes, the sign of the surface slope changing multiple times. The different slopes of the surface in each case result in different mechanical load profiles during a compression/deflection, so that load peaks of this surface thus structured may also be better compensated for.

An electroactive sound transducer foil within the sense of the present invention is a composite foil made up of at least one foil layer having piezoelectric properties, at least two electrodes, and one carrier foil. Advantageously, the design of a lowermost carrier foil and an electroactive piezoelectric layer is obtained, which is framed by at least two electrodes, each being situated on one of the two sides of the electroactive foil. However, the composite may also include multiple carrier foils and/or multiple electrodes. In particular, the individual layers may also not be present across the entire surface of the composite foil. This means that individual areas of the composite foil may also have recesses in individual layers. The composite foil may have a thickness of greater than or equal to 10 μm and less than or equal to 5,000 μm, preferably greater than or equal to 30 μm and less than or equal to 2,500 μm, and further preferably greater than or equal to 50 μm and less than or equal to 1,500 μm. Lesser composite thicknesses are not preferred since the mechanical strength of the composite may no longer be provided under load. Greater layer thicknesses, in contrast, may result in an excessively high stiffness and an excessively high mass, which may be disadvantageous for applications for sound recording (microphone), for example. The thickness of the individual layers may vary as a function of the material and of the application purpose.

The carrier foil may advantageously be formed of a material having a low specific density and high strength. For example, thin paper layers or PET foils may be used as the carrier foil. This carrier foil may have a thickness of greater than or equal to 10 μm and less than or equal to 2,000 μm, preferably greater than or equal to 30 μm and less than or equal to 1,000 μm, and further preferably greater than or equal to 50 μm and less than or equal to 500 μm. Lesser layer thicknesses may be disadvantageous for the mechanical stability of the entire composite. Greater layer thicknesses may result in an excessively high dynamically inactive mass, which may lower the sensitivity of the composite.

The electrodes may be made of a metal layer or another electrically conductive material. The metals which are known to those skilled in the art, such as aluminum, copper, silver, gold, and the like, may be used for the metallization layer. Possible electrically conductive materials are, for example, electrically conductive plastic materials such as Pedot:PSS (poly-3,4-ethylenedioxythiophene:polystyrene sulfonate). The electrodes may preferably be situated on the two sides of the piezoelectric layer including an electroactive polymer. The two electrode layers may be present across the entire surface or across only a portion of the surface. This means that either one or both electrode surface(s) cover(s) the entire transducer surface, or that one or both electrode(s) cover(s) only subareas of the transducer surface. In particular, one of the electrodes may include multiple recesses, so that no continuous electrical contact exists in the electrode. The individual electrodes may additionally be provided with one or multiple electrical feed lines.

The piezoelectric layer including an electroactive polymer may contain an electroactive polymer or be made of an electroactive polymer. It is characteristic that this layer may deform when a voltage is applied, and that a voltage is induced in the layer when a mechanical deformation occurs. It is also possible for multiple piezoelectric layers to be present on top of each other. It is possible that only 1, preferably 1 to 5, and further preferably 1 to 10, individual piezoelectric layers including an electroactive polymer is/are present. The individual layers may be obtained, for example, by successively applying individual layers and are characterized by a point of discontinuity at the layer transition. This may be detected using the established optical methods, such as microscopy. In principle, silicone elastomers, acrylic elastomers, polyurethanes, thermoplastic materials, copolymers including polyvinylidene fluoride (PVDF), pressure-sensitive adhesives, fluoroelastomers and polymers having silicone or acrylic groups may be used as electroactive polymers. The piezoelectric layer including one electroactive polymer may additionally include further additives such as plasticizers, high-molecular oils, antioxidants, viscosity modifiers and/or additional dielectric particles having high dielectric constants. The thickness of a piezoelectric layer may be greater than or equal to 1 μm and less than or equal to 1000 μm, preferably greater than or equal to 2 μm and less than or equal to 500 μm, and further preferably greater than or equal to 5 μm and less than or equal to 250 μm.

The composite foil includes a structuring, so that surface areas having different slopes are obtained. The slope of the surface areas results in a mathematical sense, so that the surface includes areas having different height differences on different length differences. The surface is preferably symmetrically structured and has at least one or particularly preferably two mirror planes which are situated perpendicularly to each other, if a surface section is viewed. The different slopes may be detected by a section through the surface of the composite foil, the slope of the surface resulting from the slope of the tangents on the outermost layer of the surface. Points of discontinuity of the surface on which no slope is determinable remain without consideration in the determination of the slope. According to the present invention, surfaces including a structuring are present, whose slope changes the sign more than twice. Standard foil sound transducer surfaces are fixed within the application situation either in a flat or a pretensioned manner in an outer frame. From this it follows that, in the first case (clamped straight), the surface slope does not change across the transducer surface, but is constant (see FIG. 1*a*). In the case of clamped, curved transducer surfaces, the curvature of the foil results in a variable slope (see FIG. 1*b*); however, this slope changes the sign of the surface slope only once, which is not in accordance with the present invention. The number of changes of signs of the slope may advantageously be determined by looking at a section through the foil surface and placing a reference point on an edge of the area. A change of sign in the slope occurs when either a positive slope (ascending surface) transitions into a negative slope (descending surface), or vice versa. If there are also subareas present in the sound transducer foil surface which are straight and neither ascend nor descend, these areas are not taken into consideration.

The structured transducer surface may be applied or attached to a wide variety of fixed objects, such as component housings, windows, walls, or even smaller objects, such as postcards or the like, in an application-specific manner.

The present invention is described in greater detail hereafter in conjunction with further aspects and specific embodiments. They may be arbitrarily combined with each other, provided the opposite is not clearly derivable from the context.

In one preferred specific embodiment, the sound transducer foil may include PVDF as the electroactive polymer. PVDF in particular has proven to be particularly suitable as the electroactive polymer in the piezoelectric layer. The piezoelectric layer may in particular include PVDF or be made of PVDF. The material exhibits good piezoelectric properties, so that sufficiently high mechanical deflections are achievable at relatively low voltages. Naturally, this also applies to the conversion of sound waves into electric current. Moreover, PVDF layers exhibit sufficient mechanical load capacity, so that sufficiently mechanically stable composites are already obtainable with low material thicknesses. The material is furthermore flexible enough to be able to be brought into various shapes within the scope of mechanical or chemical structuring. Piezoelectric layers including PVDF as the electroactive polymer may have more than 20 changes of signs of the slope, preferably more than 50 changes of signs of the slope, and further preferably more than 100 changes of signs of the slope per transducer surface. Precisely this high number of changes of signs may contribute to a higher surface and improved vibration dynamics of the structured surface.

In one further aspect of the present invention, the composite foil may include areas having different elasticity, whose edges extend in parallel to areas having a constant surface slope. The sound transducer foil composite may be designed in such a way that the material has a different elasticity or stiffness in different planar areas of the composite. These areas are advantageously oriented in such a way that changes in the elasticity of the composite foil occur in parallel to the points of the surface which have a change in the sign of the slope. It is in particular disadvantageous when the changes in elasticity of areas of the composite foil occur at an angle greater than 20°, greater than 45°, or greater than 90°, and smaller than 180°, relative to the lines having a constant surface slope. Due to the changes in the elasticity of the composite foil, it is possible to create different surface areas which have a different deflectability, for example as a function of the slope. In this way, the resonance behavior of the transducer foils according to the present invention may be influenced. The different elasticity of the composite may be achieved by using sublayers having different elasticity (e.g., the carrier layer). However it is also conceivable to impart a different elasticity to the composite foil, e.g., by a mechanical structuring using deep drawing, in the deep-drawn areas. However, it is also possible to apply further layers in subareas, which contribute to a lower elasticity in these areas. Similar effects are achievable by partial chemical or thermal treatments of the composite foil and subsequent mechanical embossing. Further examples of the ratio of the elastic areas to the slope of the surface are derived from the drawings.

In one additional characteristic, the composite foil may include more than two electrodes, whose electrode edges extend in parallel to areas having a constant surface slope. Due to this special design including multiple electrodes, whose limitations of the electrode surface extend in parallel to the areas having a constant surface slope, the different areas of the foil may be separately actuated and deflected. Due to this arrangement, the mechanical deflection of areas having a constant slope are also separately detectable. In this way, both the selectivity of the mechanical deflection of subareas of the surface and the vibration behavior of the entire composite foil may be separately controlled. The composite foil is thus tunable, which is not achievable with standard composite foils. The electrode edge limitations may advantageously extend not only in parallel to the areas having a constant surface slope, but also in parallel to potentially present planes of symmetry of the foil. This may contribute to a particularly homogeneous sound radiation of the sound transducer foil.

In one additional embodiment, an additional protective or cover layer may be applied at least partially to the outer side of the composite foil. A further layer may be applied to the composite foil to increase the mechanical strength of the composite foil, as protection against UV radiation, as protection against electric shock, or as protection of the outermost transducer layer against moisture or dust. This layer is preferably not piezoelectrically active and may be subsequently applied using methods commonly known to those skilled in the art or may be joined to the composite foil already during manufacture. Suitable layer materials are chemically inert polymers, such as poly-p-xylylene (Parylene) or other polymers, such as Teflon. This may increase the longevity and reliability of the composite foil. The layer thickness of the protective layer may advantageously be greater than or equal to 0.01 μm and less than or equal to 30 μm, preferably greater than or equal to 0.1 μm and less than or equal to 15 μm, and further preferably greater than or equal to 0.5 μm and less than or equal to 10 μm.

A method for manufacturing an electroactive sound transducer including a structured sound transducer foil is also in accordance with the present invention, characterized in that a) a sound transducer foil is produced from at least one carrier layer, at least one first and one second electrode layer, and at least one piezoelectric layer including an electroactive polymer;

b) the sound transducer foil from step a) is mechanically or chemically structured, the surface of the sound transducer foil including areas having different slopes, and the slope of the sound transducer foil surface changing the sign at least twice; and c) the structured sound transducer foil is joined to a frame or a surface. Surprisingly it has been found that this method allows sound transducers to be obtained which exhibit improved radiation and/or detection behavior. Without being bound by theory, this is the result of the increased sound transducer surface and the specific structuring of the same. In particular, the different slopes of the foil surface appear to allow better deflectability of the individual surface segments compared to standard unstructured surfaces. This may contribute to a higher sound pressure and a better frequency response of the transducer. The composite may be created in step a) from the individual components using the methods established in the related art. This is done, for example, by joining already prefabricated individual foils with subsequent lamination, or in wet processes with the aid of printing, coating with a doctor knife or the like. Those skilled in the art know the conventional processing techniques for creating composite foils.

In method step b), the sound transducer foil may be structured using a physical or chemical process in such a way that areas having different slopes are obtained. Mechanical method steps include, for example, sectional deep drawing, hot or cold pressing, as well as stretching and compressing of the composite foil, so that a permanent deformation of the foil surface having different slopes is obtained. It is furthermore advantageously possible to apply the structuring symmetrically. This means that the structuring is not applied arbitrarily, but at certain intervals having almost a constant distance. In this way, particularly effective structured sound transducer foils may be obtained. Further mechanical structuring methods include sectional heating, ultrasonic treatment or partial ablation (e.g., by lasering). Chemical methods for structuring may include, for example, sectional etching using an acid or a lye, partial intercalation of further substances, and partial surface swelling. All these physical or chemical structuring methods have in common that they result in a permanent change of the height profile of individual areas of the sound transducer foil. This change of the height profile results in different slopes of the transducer foil, which according to the present invention changes its sign at least twice.

In method step c), the structured transducer foil may then be joined to a frame. The joining may be carried out purely mechanically by clamping, or also integrally by adhesive bonding. The structured transducer foil may be inserted into the frame both in a flat and in a pretensioned manner.

In one particular specific embodiment of the present invention, vibration-hard spacers may be attached at least in subareas of the rear side of the structured sound transducer foil prior to method step c). The vibration-hard spacers contact both the composite foil and the component. Due to the conversion behavior of the structured transducer surface, it is also possible to support the rear side of subareas of the composite foil by mechanically rigid spacers, without impairing the effectiveness of the entire transducer too strongly. Without being bound by theory, the only minor worsening of the effectiveness is based on the structuring of the surface having different slope areas. The mechanically rigid spacers form a preferably vibration-mechanically rigid component. This may advantageously result in a higher mechanical strength of the entire transducer foil, since the segments in which the sound transducer foil is able to freely vibrate without support may be reduced. The structured sound transducer foil may either only be freely rested on the spacer or be permanently mechanically connected to the same. This may be done, for example, by adhesive bonding or welding. It is possible to apply either only one, or also multiple vibration-hard spacers to the rear side of the composite foil for each sound transducer foil. In one particular specific embodiment, the entire transducer surface may be divided into multiple subsurfaces, which have a symmetrical area ratio to each other, by introducing multiple vibration-hard spacers. In this way, the entire sound transducer foil may be divided into areas having different natural frequencies. This may contribute to a homogenization of the radiation behavior of the transducer at drastically different frequencies. Moreover, the strength of the foil itself may advantageously be reduced due to the mechanical support of the sound transducer foil by the vibration-hard spacers, and this may contribute to a higher sensitivity and overall better sound conversion. Vibration-hard spacers within the sense of the present invention are characterized by materials or material combinations which have a relatively high modulus of elasticity. These vibration-hard spacers may preferably have a modulus of elasticity of greater than or equal to 5,000 $N/mm^2$, preferably greater than or equal to 10,000 $N/mm^2$, and further preferably greater than or equal to 30,000 $N/mm^2$. The moduli of elasticity of the materials may be found in tabular form in the literature or may be determined with the aid of rheological measurements (e.g., with the aid of a plate/plate rheometer or vibration mechanical measurements on test specimen). These moduli of elasticity have proven to be particularly suitable for sufficient, vibration-hard stabilization of structured sound transducer surfaces.

The vibration-hard spacers may be formed of different materials. Metal, wood, plastic material or also different adhesives are conceivable. Here they are, for example, two-component adhesives, thermally curing adhesives, or epoxy-based UV-curing adhesives. The vibration-hard spacers may be placed purely mechanically onto the surface of the object prior to applying the sound transducer foil or be applied with the aid of a printing method (e.g., screen printing, flexographic printing) or with the aid of a laminating step. The width of the vibration-hard spacers may typically be greater than or equal to 5 μm and less than or equal to 5 cm, preferably greater than or equal to 5 μm and less than or equal to 2 cm, and further preferably greater than or equal to 10 μm and less than or equal to 1 cm.

In one further aspect according to the present invention, at least subareas of the rear side of the structured sound transducer foil may be contacted with a vibration-soft bed prior to method step c). Due to the structuring of the sound transducer foil, prominent supporting points may result on the rear side of the composite, which may be supported with the aid of a vibration-soft bed without significantly worsening the transducer properties. The vibration-soft bed contacts both the component to which the composite foil is applied and the composite foil, at least in subareas. In this way, the sound transducer foil may be designed to be mechanically lighter, which advantageously may result in improved vibration characteristics of the entire composite. The mechanical strength of the structured transducer surface may be improved in this way, which may additionally contribute to the longevity of the product. The vibration-soft bed is an area, filled with material, on the rear side of the sound transducer foil and is at least partially in contact with the sound transducer foil. This area thus statically creates a joint between the solid substrate and the sound transducer foil. In the relevant frequency range of the transducer, this material is elastic and thus only slightly impairs the movement of the transducer surface. A vibration mechanical effect on the resonance behavior of the transducer may be taken into consideration in the design, the material selection and the thickness of the composite foil.

The vibration-soft bed may fill the rear space of the transducer partially or entirely and may have a thickness of greater than or equal to 1 μm and less than or equal to 2,000 μm, preferably greater than or equal to 1 μm and less than or equal to 1,500 μm, and further preferably greater than or equal to 2 μm and less than or equal to 1,000 μm. Suitable materials for creating a vibration-soft bed may be silicone elastomers or silicone rubbers, two-component silicone, such as Fermasil (from Sonderhoff), elastic bodies or hollow bodies joined with the aid of adhesive, solid plastic or glass spheres, or similar materials. Furthermore, small air entrapments may also be present in or introduced into the vibration-soft bed, which may advantageously increase the compressibility of the rear transducer space. These implementation variants particularly advantageously address the property of a vibration-soft bed of keeping the layer system in a defined resting position, but putting up a low resistance to dynamic vibrations in the desired frequency range of the sound transducers (i.e., having a great resilience). Vibration-soft within the sense of the present invention is a material, or a material composition, whose dynamic area-based resilience is great. This property may be derived from the modulus of elasticity, which for vibration-soft materials may be less than or equal to 5,000 $N/mm^2$, preferably less than or equal to 1,000 $N/mm^2$, and further preferably less than or equal to 500 $N/mm^2$. The moduli of elasticity of the materials may be found in tabular form in the literature or may be determined with the aid of rheological measurements (e.g., with the aid of a plate/plate rheometer or vibration mechanical measurements on test specimen). The moduli of elasticity of the materials apply for the applicable frequency range of the sound transducers considered here of greater than or equal to 20 Hz to less than or equal to 150 kHz, preferably of greater than or equal to 100 Hz to less than or equal to 100 kHz.

In one preferred specific embodiment of the present invention, the rear transducer foil space may be supported both by a vibration-soft bed and by vibration-hard spacers. This combination of vibration-soft and vibration-hard components may contribute to particularly good mechanical support of the structured sound transducer foil.

An electroactive sound transducer, producible using the method according to the present invention, is also in accordance with the present invention. Sound transducers which are manufactured using the method according to the present invention may exhibit improved transducer properties, such as sensitivity and sound pressure, due to the structured transducer surface.

The electroactive sound transducers according to the present invention including a microstructured surface foil may be used as a microphone, a loudspeaker, a human machine interface (HMI), and a sensor. The improved transducer properties are in particular suitable for use in the above-mentioned areas in which only a limited surface is available and/or high efficiency is to be achieved.

With respect to additional advantages and features of the above-described electroactive sound transducers, reference is hereby explicitly made to the descriptions in connection with the electroactive sound transducer foil according to the present invention and the method according to the present invention. Features and advantages according to the present invention of the electroactive sound transducer foil according to the present invention shall also be applicable to, and be considered disclosed, the method according to the present invention and the sound transducers according to the present invention, and vice versa.

DETAILED DESCRIPTION

Figure 1A:
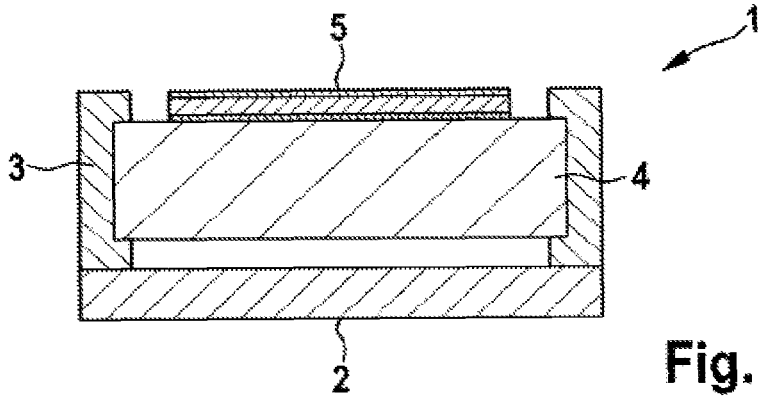
Fig. 1a Prior Art
FIG. 1*a* shows a schematic cross section of a conventional sound transducer design including a straight sound transducer foil composite.

FIG. 1*a* shows the schematic cross section of a conventional sound transducer design 1 including a component surface 2 on the rear side of the transducer, two frames or mountings 3 on the two sides of the sound transducer foil composite including a carrier layer 4 and, situated thereabove, a composite 5 made up of a piezoelectric layer and two electrode layers. The surface of the sound transducer foil is not structured, and the foil is clamped straight between the mountings 3. This results in a constant surface slope of the sound transducer foil.

Figure 1B:
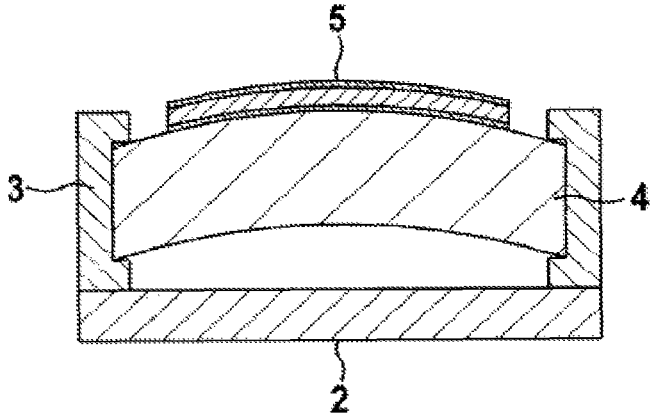
Fig. 1b Prior Art
FIG. 1*b* shows a schematic cross section of a conventional sound transducer design including a curved sound transducer foil composite.

FIG. 1*b* shows the schematic cross section of a conventional sound transducer design including a sound transducer foil composite made up of a carrier layer 4 and, situated thereabove, a piezoelectric layer and two electrode layers 5. The surface of the sound transducer foil is not structured. The composite is clamped between mountings 3 in a curved manner. This results (from left to right) first in a positive slope of the sound transducer foil surface and then, after the maximum has been exceeded, in a negative slope of the sound transducer foil surface. The sign of the slope of the sound transducer foil surface changes once, and this number of changes of signs is thus not in accordance with the present invention.

Figure 2:
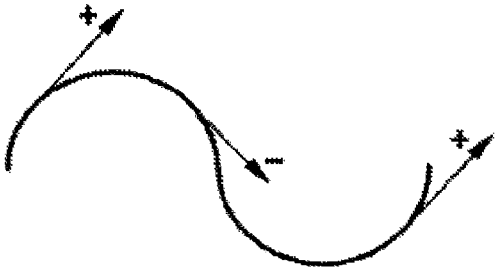
FIG. 2 shows a schematic section of a structured sound transducer surface.
Figure 3:
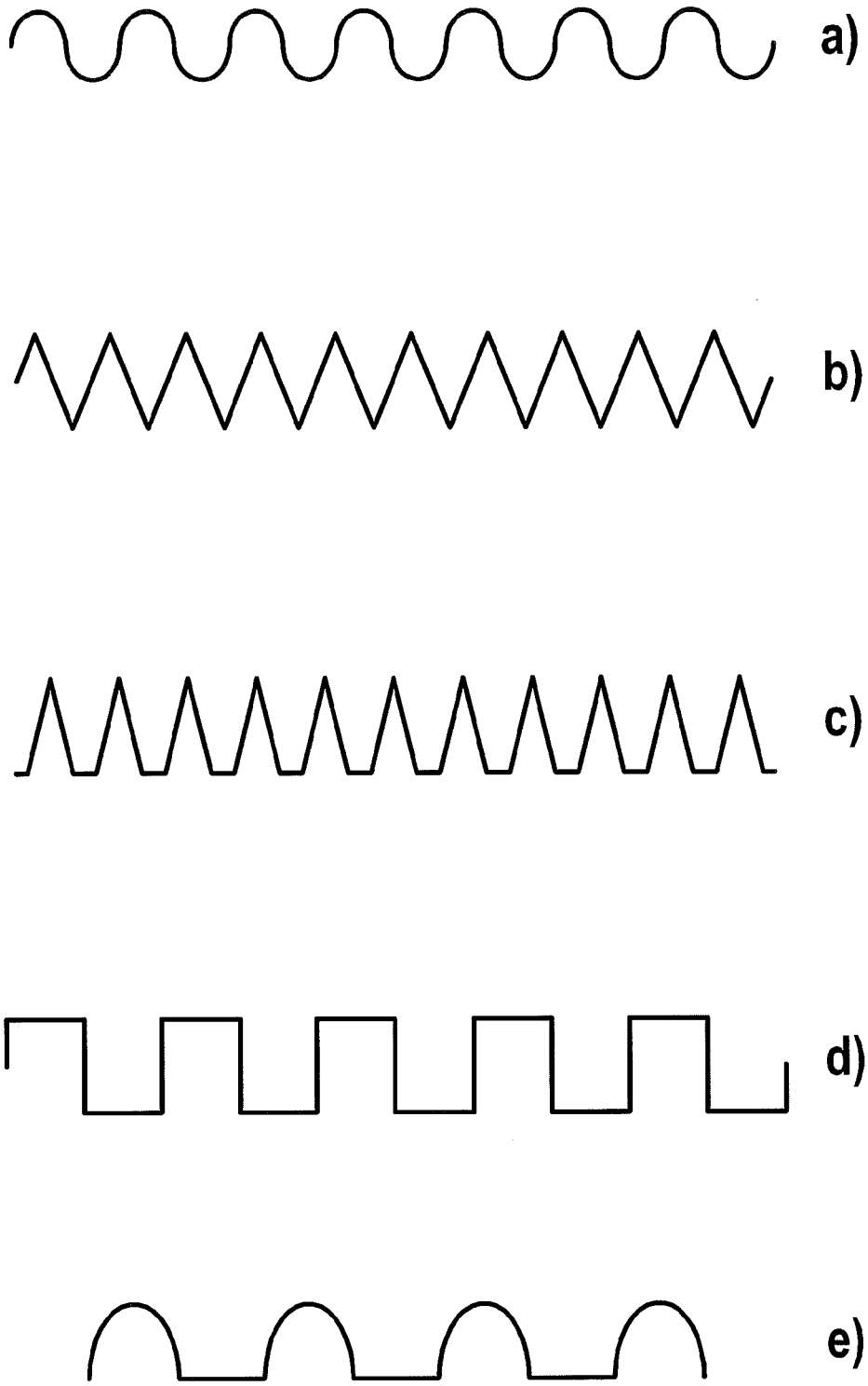
FIGS. 3*a* through 3*e* show schematic sections through different embodiments of a structured sound transducer foil.

FIG. 2 shows a schematic section of a structured sound transducer surface. From left to right, this results first in a positive slope, a maximum, a negative slope, a minimum, and then again in a positive slope. The the surface slope thus changes its sign twice. A surface which is structured according to the present invention is thus present in this subarea.

FIGS. 3*a* through 3*e* show a section through different embodiments of a structured sound transducer foil, the surface slope of the sound transducer foil changing the sign more than once. In particular preferred specific embodiments are illustrated here, which have a sequence of recurring individual elements and accordingly have a symmetrical design. However, non-periodically structured surfaces or mixed forms of the shown surfaces are also conceivable.

Figure 4:
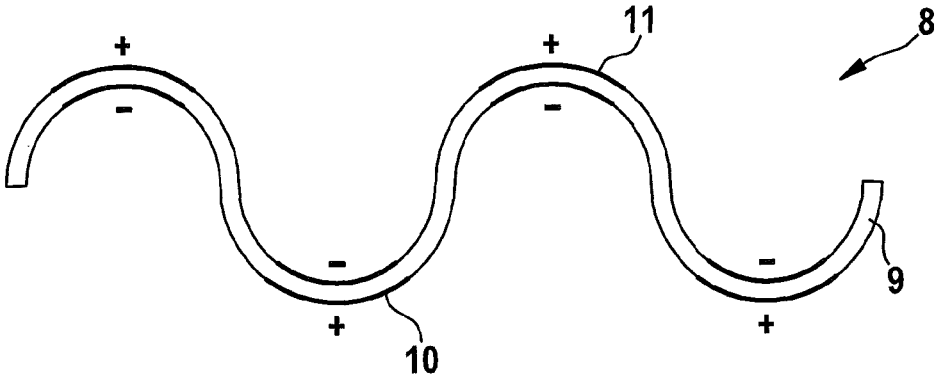
FIG. 4 shows a schematic section through a structured sound transducer surface without a carrier layer and including a piezoelectric layer and multiple electrodes.

FIG. 4 shows a section through a structured sound transducer surface 8 without carrier layer 4. The figure shows a piezoelectric layer 9 and multiple electrodes, for example 10, 11, which do not extend across the entire surface of piezoelectric layer 9. The individual edges of the electrodes extend in parallel to areas having a constant surface slope (not shown here in the section). It is in particular also within the sense of the present invention that the polarity of individual electrodes on the top side/bottom side of the piezoelectric layer is not constant, but variable. In this way, different surface areas of the piezoelectric layer including an electroactive polymer may be differently polarized in the same unit of time.

Figure 5:
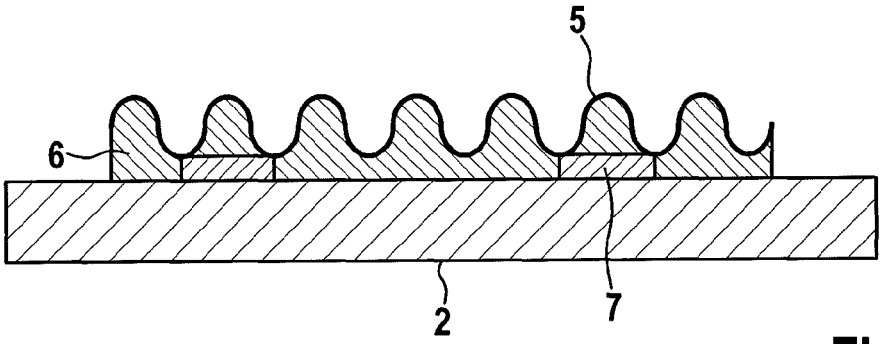
FIG. 5 shows a schematic section through a sound transducer including a sound transducer foil having a structured surface on a vibration-hard spacer and a vibration-soft bed.

FIG. 5 shows a section through a sound transducer including a sound transducer foil having a structured surface 5. The sound transducer is situated on a solid body 2 and is stabilized by vibration-hard spacers 7 and a vibration-soft bed 6. Situations in which the sound transducer foil is stabilized either only by vibration-hard spacers 7 or only by a vibration-soft bed 6 are also within the sense of the present invention. Vibration-soft bed 6 may fill the entire rear space of solid body 2 to the sound transducer foil. However, designs in which vibration-soft bed 6 is in contact only with subareas of the sound transducer foil having structured surface 5 may also be in accordance with the present invention. The sound transducer foil having structured surface 5 may both include a further purely mechanical carrier foil and have a design without a carrier foil.

Figure 6:
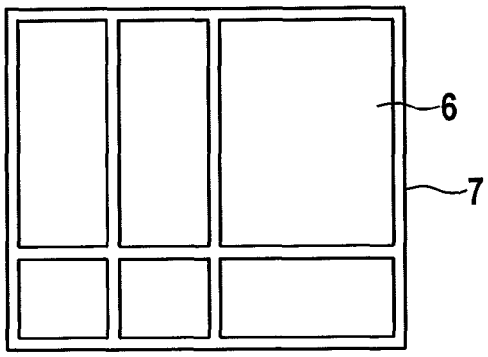
FIG. 6 shows a schematic top view onto a transducer substructure made of a vibration-soft bed and vibration-hard spacers.

FIG. 6 shows a schematic top view onto a transducer substructure made of vibration-soft bed 6 and vibration-hard spacers 7. The structured sound transducer foil is not shown in the schematic top view. Due to the arrangement of the vibration-hard spacers 7, it is possible to form different transducer subareas, which may have a different surface and thus also different resonance properties. In this way, the sound transducer may be matched to the particular designed field of application by the selection of the substructure. Specific embodiments in which only vibration-hard spacers 7 without vibration-soft bed 6 are present are also in accordance with the present invention.

What is claimed is:

1. An electroactive sound transducer foil, comprising:

a composite foil having:

a carrier foil;

a first electrode;

a second electrode; and a piezoelectric layer including an electroactive polymer;

a vibration-soft bed to which the composite foil is applied; and vibration-hard spacers crisscrossing the vibration-soft bed, thereby dividing a surface of the transducer foil into a plurality of areas having different natural frequencies;

wherein:

a modulus of elasticity of material of which the vibration-hard spacers are made is greater than a modulus of elasticity of material of which the vibration-soft bed is made;

the transducer foil includes at least one surface, a slope of which changes sign at least twice; and at least one of:

(a) one of the at least one surface is a surface of the piezoelectric layer;

(b) one of the at least one surface is a surface of the first electrode;

(c) one of the at least one surface is a surface of the second electrode; and (d) when viewed in a direction that is perpendicular to the at least one surface, the at least one surface forms a two-dimensional plane that is perpendicular to a stacking direction in which the first electrode, second electrode, and piezoelectric layer are stacked over each other.

2. The sound transducer foil as recited in claim 1, wherein the electroactive polymer includes PVDF.

3. The sound transducer foil as recited in claim 1, wherein elasticity of the composite foil varies along the slope.

4. The sound transducer foil as recited in claim 1, further comprising a third electrode, wherein electrode edges of the first, second, and third electrodes extend in parallel to areas having a constant surface slope.

5. The sound transducer foil as recited in claim 1, further comprising an additional protective or cover layer applied at least partially to an outer side of the composite foil.

6. A method for manufacturing an electroactive sound transducer having a structured sound transducer foil, the method comprising: producing a sound transducer foil from a carrier layer, a first electrode layer, a second electrode layer, and a piezoelectric layer including an electroactive polymer, wherein: the carrier layer, first electrode layer, second electrode layer, and piezoelectric layer form a composite foil; the composite foil is applied to a vibration-soft bed, and vibration-hard spacers crisscross the vibration-soft bed, thereby dividing a surface of the transducer foil into a plurality of areas having different natural frequencies; and a modulus of elasticity of material of which the vibration-hard spacers are made is greater than a modulus of elasticity of material of which the vibration-soft bed is made; one of mechanically and chemically structuring the sound transducer foil to include at least one surface, a slope of which changes sign at least twice, wherein at least one of: (a) one of the at least one surface is a surface of the piezoelectric layer; (b) one of the at least one surface is a surface of the first electrode; (c) one of the at least one surface is a surface of the second electrode; and (d) when viewed in a direction that is perpendicular to the at least one surface, the at least one surface forms a two-dimensional plane that is perpendicular to a stacking direction in which the first electrode, second electrode, and piezoelectric layer are stacked over each other; and joining the structured sound transducer foil to one of a frame and a surface.

7. The method as recited in claim 6, further comprising attaching vibration-hard spacers at least in subareas of a rear side of the structured sound transducer foil prior to the joining step.

8. The method as recited in claim 6, further comprising contacting at least subareas of a rear side of the structured sound transducer foil with a vibration-soft bed prior to the joining step.

9. An electroactive sound transducer, producible using a method for manufacturing an electroactive sound transducer having a structured sound transducer foil, the method comprising: producing a sound transducer foil from a carrier layer, a first electrode layer, a second electrode layer, and a piezoelectric layer including an electroactive polymer, wherein: the carrier layer, first electrode layer, second electrode layer, and piezoelectric layer form a composite foil; the composite foil is applied to a vibration-soft bed, and vibration-hard spacers crisscross the vibration-soft bed, thereby dividing a surface of the transducer foil into a plurality of areas having different natural frequencies; and a modulus of elasticity of material of which the vibration-hard spacers are made is greater than a modulus of elasticity of material of which the vibration-soft bed is made; one of mechanically and chemically structuring the sound transducer foil to include at least one surface, a slope of which changes sign at least twice, wherein at least one of: (a) one of the at least one surface is a surface of the piezoelectric layer; (b) one of the at least one surface is a surface of the first electrode; (c) one of the at least one surface is a surface of the second electrode; and (d) when viewed in a direction that is perpendicular to the at least one surface, the at least one surface forms a two-dimensional plane that is perpendicular to a stacking direction in which the first electrode, second electrode, and piezoelectric layer are stacked over each other; and joining the structured sound transducer foil to one of a frame and a surface.

10. A method comprising using an electroactive sound transducer as one of a microphone, a loudspeaker, a human machine interface (HMI), and a sensor, wherein:

the electroactive sound transducer includes:

a composite sound transducer foil that includes a carrier layer, a first electrode layer, a second electrode layer, and a piezoelectric layer including an electroactive polymer;

a vibration-soft bed to which the composite foil is applied; and vibration-hard spacers crisscrossing the vibration-soft bed, thereby dividing a surface of the transducer foil into a plurality of areas having different natural frequencies;

a modulus of elasticity of material of which the vibration-hard spacers are made is greater than a modulus of elasticity of material of which the vibration-soft bed is made;

the composite foil includes at least one a surface, a slope of which changes sign at least twice; and at least one of:

(a) one of the at least one surface is a surface of the piezoelectric layer;

(b) one of the at least one surface is a surface of the first electrode;

(c) one of the at least one surface is a surface of the second electrode; and (d) when viewed in a direction that is perpendicular to the surface, the at least one surface forms a two-dimensional plane that is perpendicular to a stacking direction in which the first electrode, second electrode, and piezoelectric layer are stacked over each other.

11. The sound transducer foil as recited in claim 1, wherein the first and second electrodes are arranged along only a portion of the piezoelectric layer.

12. The sound transducer foil as recited in claim 1, wherein the modulus of elasticity of the vibration-hard spacers is greater than or equal to 5,000 $N/mm^2$ and the modulus of elasticity of the vibration-soft bed is less than or equal to 5,000 $N/mm^2$.

13. The sound transducer foil as recited in claim 1, wherein the modulus of elasticity of the vibration-hard spacers is greater than or equal to 10,000 $N/mm^2$ and the modulus of elasticity of the vibration-soft bed is less than or equal to 1,000 $N/mm^2$.

14. The sound transducer foil as recited in claim 1, wherein the modulus of elasticity of the vibration-hard spacers is greater than or equal to 30,000 $N/mm^2$ and the modulus of elasticity of the vibration-soft bed is less than or equal to 500 $N/mm^2$.

15. The sound transducer foil as recited in claim 3, wherein changes in the elasticity of the composite foil along the slope occur at locations in which a sign of the slope changes.

16. The sound transducer foil as recited in claim 3, wherein changes in the elasticity of the composite foil along the slope are due to differences in elasticity of sublayers of the composite foil at different locations along the slope.

* * * * *